US009423170B2

(12) United States Patent
Celik et al.

(10) Patent No.: US 9,423,170 B2
(45) Date of Patent: Aug. 23, 2016

(54) COOLING DEVICE COMPRISING A DOOR OPENING MECHANISM

(71) Applicant: Arcelik Anonim Sirketi, Istanbul (TR)

(72) Inventors: Kadir Ridvan Celik, Istanbul (TR); Elif Altay, Istanbul (TR)

(73) Assignee: Arcelik A.S., Istanbul (TR)

( * ) Notice: Subject to any disclaimer, the term of this patent is extended or adjusted under 35 U.S.C. 154(b) by 0 days.

(21) Appl. No.: 14/370,036

(22) PCT Filed: Dec. 18, 2012

(86) PCT No.: PCT/EP2012/075941
§ 371 (c)(1),
(2) Date: Jun. 30, 2014

(87) PCT Pub. No.: WO2013/098122
PCT Pub. Date: Jul. 4, 2013

(65) Prior Publication Data

US 2014/0354135 A1 Dec. 4, 2014

(30) Foreign Application Priority Data

Dec. 30, 2011 (TR) ..... A 2011 13325

(51) Int. Cl.

| | |
|---|---|
| ***F25D 23/02*** | (2006.01) |
| ***E05B 1/00*** | (2006.01) |
| ***E05B 17/00*** | (2006.01) |
| ***E05D 11/00*** | (2006.01) |
| ***F25D 11/00*** | (2006.01) |

(52) U.S. Cl.
CPC ..... *F25D 23/028* (2013.01); *E05B 1/0015* (2013.01); *E05B 17/0033* (2013.01); *E05D 11/00* (2013.01); *F25D 11/00* (2013.01)

(58) Field of Classification Search
CPC ..... F25D 23/028; E05B 1/003; E05B 1/0015; E05B 17/0033; E05D 11/00
USPC ..... 312/401, 405, 326, 329; 49/276, 277, 49/278, 364; 292/DIG. 71
See application file for complete search history.

(56) References Cited

U.S. PATENT DOCUMENTS

| | | | | |
|---|---|---|---|---|
| 3,201,960 | A * | 8/1965 | Berkowitz | 70/150 |
| 5,915,805 | A * | 6/1999 | Lee | 312/405 |
| 6,375,291 | B1 * | 4/2002 | Nam et al. | 312/405 |
| 7,784,219 | B2 * | 8/2010 | Yoshikawa et al. | 49/379 |
| 2003/0090187 | A1 * | 5/2003 | Kawamura et al. | 312/401 |
| 2008/0163462 | A1 * | 7/2008 | King | 16/412 |
| 2009/0179540 | A1 * | 7/2009 | Seo | 312/405 |

* cited by examiner

*Primary Examiner* — James O Hansen
(74) *Attorney, Agent, or Firm* — Venjuris P.C.

(57) ABSTRACT

The present invention relates to a cooling device (1) comprising a body (2) wherein the objects to be cooled are placed, at least one door (3) providing access into the body (2) and a door opening mechanism (4) situated on each door (3), having a handle (5) that rotates around the axis parallel to the short side of the door (3) and that the user moves to open the door (3), an extension (8) with at least some portion in geared form, extending from the handle (5) towards the body (2) parallel to the side wall of the door (3) and moving together with the handle (5), a latch (6) actuated by the movement of the handle (5) having a pusher (7) disposed at the end portion, providing the door (3) to separate from the body (2) and a transmission member (9) that transmits the movement of the extension (8) to the latch (6), and wherein the door (3) thereof can be easily opened and closed.

18 Claims, 4 Drawing Sheets

COOLING DEVICE COMPRISING A DOOR OPENING MECHANISM

Figure 1:
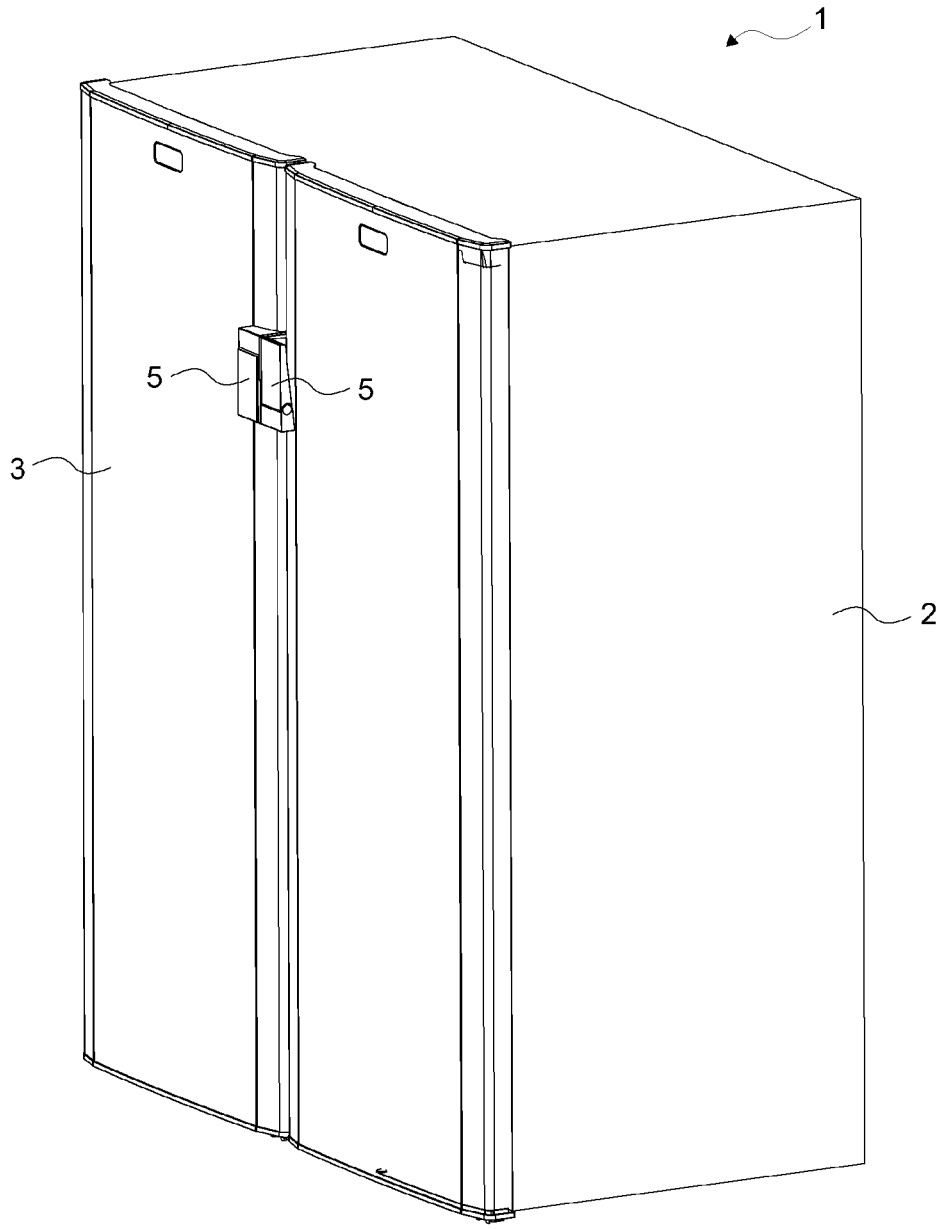

The present invention relates to a cooling device comprising a door opening mechanism.

In cooling devices, for example in refrigerators, doors are provided which allow access to the interior of the cooling device and which separate the fresh food compartment from the outside environment. The said doors are opened/closed by means of a handle. Sometimes vacuum occurs around the door due to the temperature difference between the interior environment and the outside environment and opening the door by means of the handle becomes difficult. Door opening mechanisms are used that provide the door to be easily separated from the body for the solution of this problem. In these mechanisms, the handle is rotatably mounted to the edge of a support member whereon the movement mechanism is situated and the support member is fixed on the side wall of the door. In the state of the art door opening mechanisms, the members of the mechanism cannot be used effectively since the area wherein the movement transmission mechanisms are disposed is limited. In door opening mechanisms, generally the rotational movement of the handle is converted into linear movement and is transmitted to the latch that provides the door to be separated from the body. In these embodiments, opening the door becomes difficult since the force exerted by the user cannot be transmitted efficiently.

In the state of the art European Patent Document No. EP0891542, a freezer is described that comprises a door opening mechanism having a long arm used as the handle that is held while opening the door and a short arm that bears against the body when the long arm is actuated.

In the state of the art International Patent Application No. WO2005057106, a door opening mechanism is described that comprises a pinion gear mechanism which is connected to the handle, a rack which is actuated by the pinion and a pusher member which is actuated by the rack and provides the door to be opened ajar by pushing the body.

In the state of the art European Patent Document No. EP1174668, a door opening mechanism is described, comprising a handle which is mounted on the side wall of the door of the cooling device and which rotates when pulled and thus facilitates the separation of the door from the body. The door opening mechanism is used on the door of a single door refrigerator. In this embodiment a spring is disposed between the handle and the plunger whereto its movement is transmitted.

In the state of the art U.S. Pat. No. 5,915,805, a cooling device is described, comprising a door opening mechanism. In this embodiment, the handle rotates around the axis that is parallel to the floor. The rotational movement of the handle is transmitted to the operating member by converting into linear motion. The operating member exerts pressure towards the body and thus provides the door to separate from the body.

In the state of the art Chinese Utility Model No. CN201165778, a cooling device is described that comprises a door opening mechanism. In the door opening mechanism, a handle that can rotate around the axis vertical to the floor and an arm that converts the movement of the handle into linear motion are disposed. In this embodiment, there is a geared-fitting connection between the handle and the arm.

In the state of the art International Patent Application No. WO2007113230, a cooling device is described that comprises a handle which is opened by rotating around an axis parallel to the floor. In this embodiment, the handle provides the door to be opened when either pushed or pulled.

The aim of the present invention is the realization of a cooling device comprising a door opening mechanism which provides the door to be opened easily.

The cooling device realized in order to attain the aim of the present invention, explicated in the first claim and the respective claims thereof, comprises a handle that is made to perform rotational movement by the user and a latch having a pusher that implements pushing movement from the door towards the body as a result of transmitting the movement of the handle. The cooling device furthermore comprises an extension that extends from the lateral side of the handle towards the cooling device body and having a geared portion at its end. The extension is preferably produced as a single piece together with the handle. There is almost a ninety degree angle between the handle and the extension.

The cooling device of the present invention comprises a transmission member that transmits the movement of the extension to the latch. The transmission member is rotatably placed between the extension and the latch. In the transmission member, a geared surface that contacts the gears on the extension and a cam surface that contacts the latch are situated. When the handle is rotated, the extension also moves and actuates the transmission member by means of the geared surface. The cam surface of the transmission member makes sliding motion on the side of the latch, providing the latch to rotate and the pusher to move from the door towards the body. The pusher provides the door to be pushed outwards by bearing against a surface on the body.

In an embodiment of the present invention, the gear diameters of the extension and the transmission member are different from each other. In this embodiment, preferably the gear diameter of the extension is greater than the gear diameter of the geared surface on the transmission member. Provided that the transmission member and the latch remain the same, as the gear ratio between the extension and the transmission member gets larger, the force required to be exerted on the handle for opening the door becomes smaller. This provides the user to open the door more easily.

In an embodiment of the present invention, the longest distance from the center of the transmission member to the cam surface is greater than the longest distance from the center of the transmission member to the geared surface. Thus, even though the geared surface moves on a smaller arc, it provides the cam surface to move on a wider arc. Consequently, the force exerted on the transmission member is transmitted unto the latch efficiently.

In an embodiment of the present invention, the rotation point of the latch is closer to the body than the rotation point of the transmission member. The surface of the latch contacting with the cam surface extends from its center in a convex form towards the cam surface. The pusher is situated on the side of the latch center facing the body. Thus, the motion received from the transmission member by the latch is transmitted to the pusher efficiently.

In an embodiment of the present invention, the transmission member is disposed in the section of the door opening mechanism close to the base of the body and the latch is disposed in the section of the door opening mechanism close to the ceiling of the body. The rotation point of the latch is situated at a point close to its upper side and the rotation point of the transmission member at a point close to its lower side. In this embodiment, the cam surface extends from the center level of the transmission member towards the center level of the latch, not exceeding the vertical direction of the latch center. Thus, the rate of transmission increases and the amount of force required for moving the pusher decreases.

In an embodiment of the present invention, the latch and the transmission member are fixed on a support member and the extension moves on the support member. Thus, occurrence of eccentricity between the movement directions of the extension, the transmission member and the latch is prevented. Furthermore, the members of the door opening mechanism can be joined directly on the support member before being mounted to the door and is mounted on the door all together after taking its final form. This provides ease of assembly. In this embodiment, the support member functions as a casing.

In an embodiment of the present invention, the door opening mechanism is used on the doors of a cooling device having two side-by-side doors. In this embodiment, the door opening mechanisms are disposed such that the support members face one another. The door opening mechanisms are situated side by side at the middle section of the cooling device.

In a version of this embodiment, the same door opening mechanism can be used for both of the doors. The door opening mechanisms, identical with one another, are disposed upright on one door and upside down on the other door. Thus, the need for storing different door opening mechanisms for the right door and the left door is eliminated. This provides great convenience in terms of logistics and production.

In an embodiment of the present invention, the members of the door opening mechanism except the handle cannot be seen by the user. The transmission member, the latch and the extension are situated on the support member and the support member extends towards the body from the rear side of the handle facing the door. Consequently, the user is prevented from breaking down the door opening mechanism by tinkering with the movable members.

In an embodiment of the present invention, the door opening mechanism is placed in a cavity formed on the door. In this embodiment, the outer surface of the handle is preferably a flat plate that is shaped rectangularly. Thus, the door opening mechanism does not project outwards from the exterior surface of the door and hence both the appearance of the cooling device is improved and also the number of cooling devices transported per unit vehicle is increased by decreasing the packaging volume.

By means of the present invention, the door of the cooling device can be opened without requiring too much force. The sudden movement of the door at the moment it is released from vacuum effect is prevented by means of the door opening smoothly.

The cooling device realized in order to attain the aim of the present invention is illustrated in the attached figures, where:

FIG. 1—is the perspective view of the cooling device of the present invention.

Figure 2:
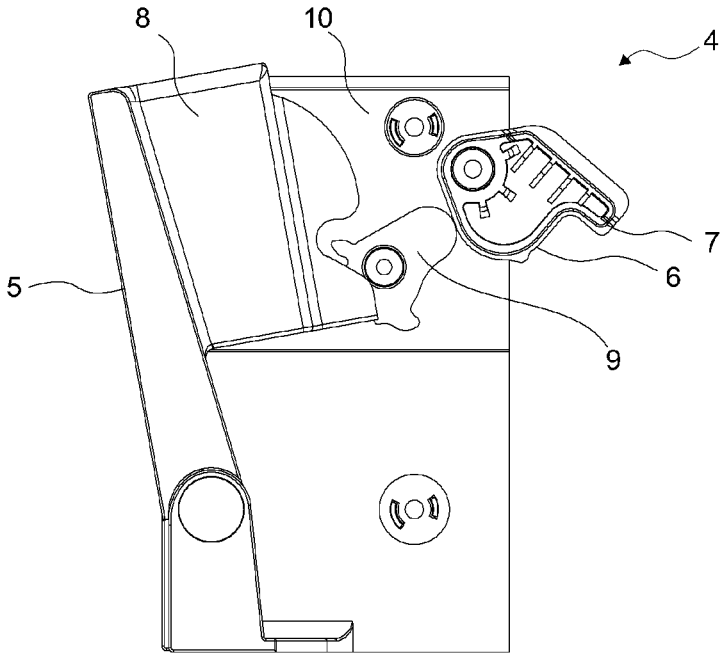

FIG. 2—is the sideways view of the door opening mechanism.

Figure 3:
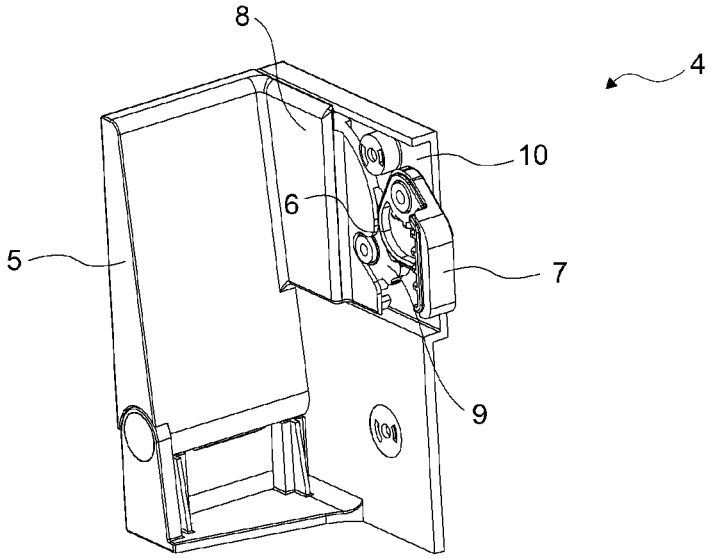

FIG. 3—is the perspective view of the door opening mechanisms.

Figure 4:
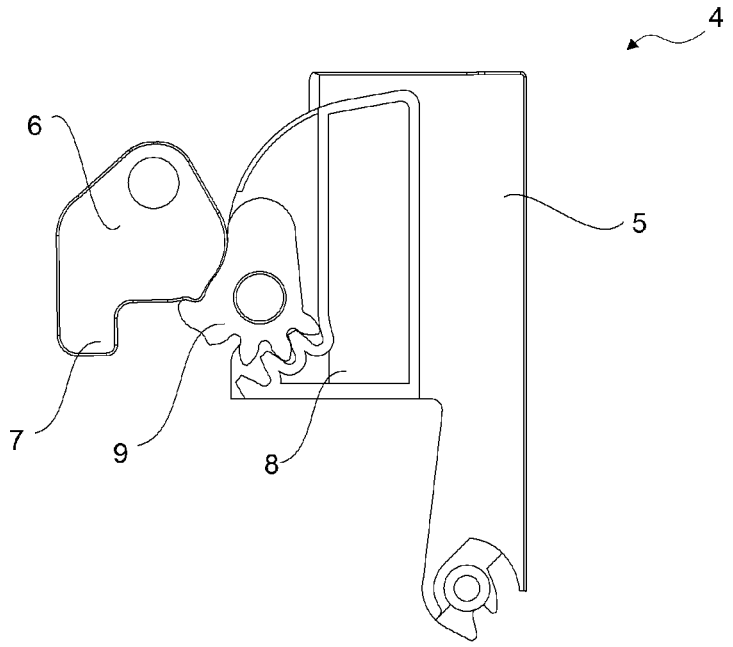

FIG. 4—is the partial view of the door opening mechanism while the door is being opened.

Figure 5:
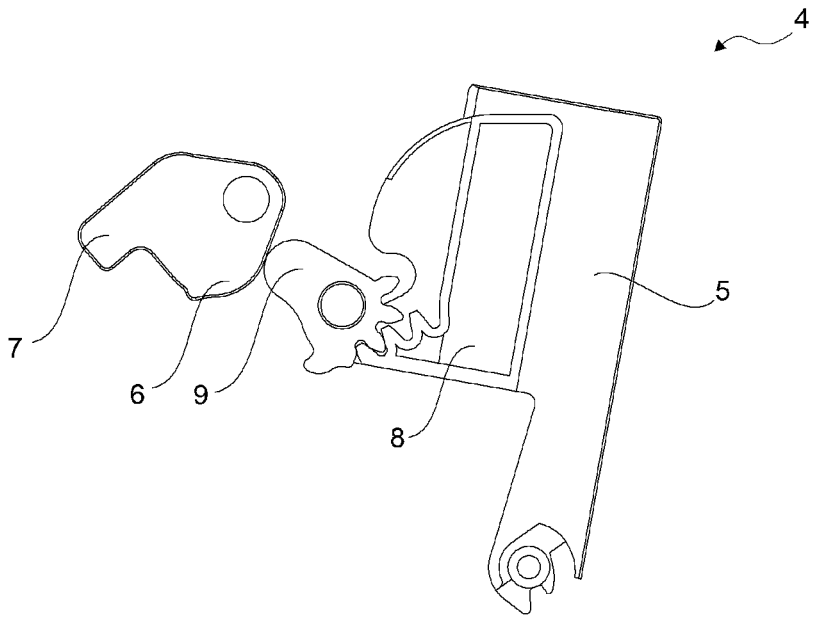

FIG. 5—is the partial view of the door opening mechanism while the door is closed.

Figure 6:
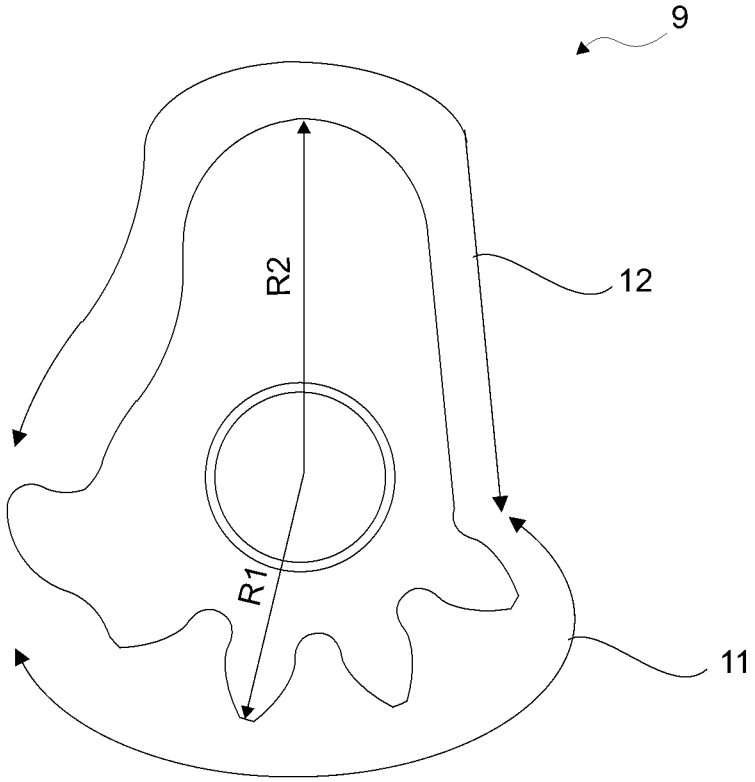

FIG. 6—is the front view of the transmission member.

The elements illustrated in the figures are numbered as follows:

1. Cooling device
2. Body
3. Door
4. Door opening mechanism
5. Handle
6. Latch
7. Pusher
8. Extension
9. Transmission member
10. Support member
11. Geared surface
12. Cam surface The cooling device (1) comprises a body (2) wherein the objects to be cooled are placed, at least one door (3) providing access into the body (2) and a door opening mechanism (4) disposed on the door (3) (FIG. 1).

The door opening mechanism (4) comprises

- a handle (5) that rotates around the axis parallel to the short side of the door (3) and that the user moves to open the door (3),
- an extension (8) with at least some portion in geared form, extending from the handle (5) towards the body (2) parallel to the side wall of the door (3) and moving together with the handle (5) and
- a latch (6) actuated by the movement of the handle (5), having a pusher (7) at the end portion, providing the door (3) to separate from the body (2).

When the door (3) is in the closed position, the handle (5) makes rotational movement when pulled. The rotational movement of the handle (5) is transmitted to the extension (8) whereto it is connected, and the motion of the extension (8) to the latch (6) and upon rotation of the latch (6), the pusher (7) is provided to move from the door (3) towards the body (2). By means of the movement of the pusher (7), the vacuum effect inside the cooling device (1) is eliminated and the door (3) is provided to be opened easily. When the handle (5) is released, the handle (5) and the latch (6) resume their initial positions by means of the springs comprised in the door opening mechanism (4) (FIG. 2, FIG. 3).

The door opening mechanism (4) furthermore comprises a transmission member (9) that is rotatably disposed between the extension (8) and the latch (6) and that transmits the movement of the extension (8) to the latch (6). In this embodiment, the transmission member (9) comprises a geared surface (11) that contacts with the geared part of the extension (8) and a cam surface (12) that rotates the latch (6) by sliding on the latch (6). The geared part of the extension (8), that is activated when the handle (5) is rotated by the user, rotates the transmission member (9) by interacting with the geared surface (11) on the transmission member (9). On the other hand, the transmission member (9) rotates the latch (6) by rolling on the latch (6) whereto it is connected by means of the cam surface (12). The pusher (7) at the end portion of the latch (6) applies pressure on the body (2) with the effect of rotation and provides the door (3) to be separated from the body (2). The door (3) is provided to be opened easily by means of the movement being transmitted efficiently between the rotatable members and not being converted into linear movement. Consequently, rotating the handle (5) with a smaller angle by the user is sufficient for opening of the door (3) and accordingly ease of utilization is provided (FIG. 2, FIG. 3, FIG. 4, FIG. 5, FIG. 6).

In an embodiment of the present invention, the gear diameter of the geared surface (11) is smaller than the gear diameter of the extension (8). Thus, when the handle (5) is moved, the transmission member (9) rotates by making more turns than the extension (8). This, provides the latch (6) to be moved by a lesser amount of force and hence the door (3) to be opened more easily.

In an embodiment of the present invention, the distance (R1) between the rotation point of the transmission member (9) and the endpoint of the geared surface (11) is smaller than the distance (R2) between the rotation point and the endpoint of the cam surface (12). In this embodiment, the cam surface (12) sweeps a larger area than the geared surface (11) with the same rotational angle. Thus, the latch (6) is provided to be rotated effectively and the geared surface (11) can move without impacting the base of the door opening mechanism (4) (FIG. 6).

In an embodiment of the present invention, the surface of the latch (6) contacting the cam surface (12) is curved so as to extend from the rotation point towards the transmission member (9). In this embodiment, the surface that contacts the cam surface (12) extends downwards from the rotation point of the latch (6). The pusher (7) extends downwards from the other side of the rotation point of the latch (6). Thus, there isn't any movement space between the transmission member (9) and the latch (6) and as soon as the transmission member (9) starts moving, the pusher (7) is also activated (FIG. 4, FIG. 5).

In an embodiment of the present invention, the cooling device (1) comprises the transmission member (9), the rotation point of which is almost at the lower end level of the handle (5), the latch (6), the rotation point of which is almost at the upper end level of the handle (5) and the cam surface (12) that extends approximately between the rotation point of the transmission member (9) and the rotation point of the latch (6). As the distance (R2) from the cam surface (12) endpoint to the rotation point of the transmission member (9) increases, the movement efficiency between the transmission member (9) and the latch (6) also increases. Thus, the door (3) can be opened even if the handle (5) is rotated with a smaller angle.

In an embodiment of the present invention, the door opening mechanism (4) comprises a support member (10), disposed on the side wall of the door (3), and whereon the extension (8), the transmission member (9) and the latch (6) are situated. In this embodiment, the transmission member (9) and the latch (6) are rotatably fixed on the support member (10). The extension (8) also moves on the support member (10). Thus, the extension (8), the transmission member (9) and the latch (6) move on the same plane and accordingly the door opening mechanism (4) is provided to function properly. Furthermore, the door opening mechanism (4) is mounted to the door (3) by being grouped on the support member (10) and thus ease of assembly is provided (FIG. 2, FIG. 3).

In an embodiment of the present invention, the cooling device (1) comprises two doors (3) that remain side by side when closed. In this embodiment, one door opening mechanism (4) is mounted on each door (3). The door opening mechanisms (4) are preferably disposed on the side walls of the doors (3) that face one another. The handles (5) are prevented from overlapping with one another at the center point by means of the handles (5) rotating around the axis that is parallel to the floor (FIG. 1).

In a version of this embodiment, the door opening mechanisms (4) are identical and disposed reverse-symmetrically on the doors (3). Thus, ease of production and storage are provided and cost advantage is maintained. In this embodiment, the handles (5) rotate in opposite directions with respect to one another (FIG. 1).

In an embodiment of the present invention, the support member (10), the extension (8), the transmission member (9) and the latch (6) are not seen from the outside while the door opening mechanism (4) is not used. Thus, the movable members of the door opening mechanism (4) are protected from exterior interventions and prevented from malfunctioning. Furthermore, the visual unity is prevented from being distorted.

In an embodiment of the present invention, the handle (5) is plate shaped. In this embodiment, the door opening mechanism (4) is mounted on the door (3) such that the handle (5) and the door (3) are coplanar. Thus, in situations wherein the cooling device (1) is placed near a wall or furniture, the handle (5) is prevented from being damaged by hitting the wall or furniture when the door (3) is opened. Furthermore, the transportation costs decrease since the package volume of the cooling device (1) decreases.

By means of the present invention, the door (3) of the cooling device (1) can be opened easily by a small force exerted on the handle (5). This provides ease of utilization.

It is to be understood that the present invention is not limited to the embodiments disclosed above and a person skilled in the art can easily introduce different embodiments. These should be considered within the scope of the protection postulated by the claims of the present invention.

The invention claimed is:

1. A cooling device (1) comprising a body (2), at least one door (3) providing access into the body (2) and a door opening mechanism (4) disposed on the door (3), having a handle (5) that rotates around an axis parallel to a short side of the door (3) and that a user moves to open the door (3), an extension (8) with at least some portion defining a geared part, extending from the handle (5) towards the body (2) parallel to a side wall of the door (3) and moving together with the handle (5) and a latch (6) actuated by the movement of the handle (5), having a pusher (7) disposed at an end portion, providing the door (3) to separate from the body (2), and a transmission member (9) disposed rotatably between the extension (8) and the latch (6), transmitting the movement of the extension (8) to the latch (6), having a geared surface (11) that contacts with the geared part of the extension (8) and a cam surface (12) that rotates the latch (6) by sliding on the latch (6).

2. The cooling device (1) as in claim 1, wherein the geared surface (11) includes a gear diameter of which is smaller than a gear diameter of the extension (8).

3. The cooling device (1) as in claim 2, wherein the transmission member (9) comprises a R1 distance between a rotation point thereof and an endpoint of the geared surface (11) that is smaller than a R2 distance between a rotation point and an endpoint of the cam surface (12).

4. The cooling device (1) as in claim 3, wherein the latch (6) includes a surface contacting the cam surface (12) which is curved so as to extend from the rotation point towards the transmission member (9).

5. The cooling device (1) as in claim 4, wherein the transmission member (9) includes a rotation point of which is almost at a lower end level of the handle (5), the latch (6), the rotation point of which is almost at a upper end level of the handle (5) and the cam surface (12) that extends between approximately the rotation point of the transmission member (9) and the rotation point of the latch (6).

6. The cooling device (1) as in claim 5, wherein the door opening mechanism (4) comprises a support member (10), disposed on the side wall of the door (3), and whereon the extension (8), the transmission member (9) and the latch (6) are situated.

7. The cooling device (1) as in claim 6, wherein the at least one door is two doors (3) which remain side by side when closed and one door opening mechanism (4) being situated on each of the two doors.

8. The cooling device (1) as in claim 7, wherein the door opening mechanisms (4) are identical and disposed reverse-symmetrically on the two doors (3).

9. The cooling device (1) as in claim 8, wherein the support member (10), the extension (8), the transmission member (9) and the latch (6) are not seen from the outside while the door opening mechanisms (4) are not used.

10. The cooling device (1) as in claim 9, wherein the handle is plate shaped and the door opening mechanism (4) is placed on the door (3) such that the handle (5) and the door (3) are coplanar.

11. The cooling device (1) as in claim 1, wherein the transmission member (9) comprises a R1 distance between a rotation point thereof and an endpoint of the geared surface (11) that is smaller than a R2 distance between a rotation point and an endpoint of the cam surface (12).

12. The cooling device (1) as in claim 1, wherein the latch (6) includes a surface contacting the cam surface (12) which is curved so as to extend from the rotation point towards the transmission member (9).

13. The cooling device (1) as in claim 1, wherein the transmission member (9) includes a rotation point of which is almost at a lower end level of the handle (5), the latch (6), the rotation point of which is almost at a upper end level of the handle (5) and the cam surface (12) that extends between approximately the rotation point of the transmission member (9) and the rotation point of the latch (6).

14. The cooling device (1) as in claim 1, wherein the door opening mechanism (4) comprises a support member (10), disposed on the side wall of the door (3), and whereon the extension (8), the transmission member (9) and the latch (6) are situated.

15. The cooling device (1) as in claim 1, wherein the at least one door is two doors (3) which remain side by side when closed and one door opening mechanism (4) being situated on each of the two doors.

16. The cooling device (1) as in claim 15, wherein the door opening mechanisms (4) are identical and disposed reverse-symmetrically on the two doors (3).

17. The cooling device (1) as in claim 1, further comprising a support member and wherein the support member (10), the extension (8), the transmission member (9) and the latch (6) are not seen from the outside while the door opening mechanisms (4) are not used.

18. The cooling device (1) as in claim 1, wherein the handle is plate shaped and the door opening mechanism (4) is placed on the door (3) such that the handle (5) and the door (3) are coplanar.

* * * * *